US006993999B2

(12) United States Patent
Wong

(10) Patent No.: US 6,993,999 B2
(45) Date of Patent: Feb. 7, 2006

(54) EXPANDER LOCKING PLIER

(76) Inventor: Harry Wong, 507 Camino Verde, South Pasadena, CA (US) 91030

( * ) Notice: Subject to any disclaimer, the term of this patent is extended or adjusted under 35 U.S.C. 154(b) by 0 days.

(21) Appl. No.: 10/662,489

(22) Filed: Sep. 15, 2003

(65) Prior Publication Data

US 2004/0055430 A1 Mar. 25, 2004

Related U.S. Application Data

(60) Provisional application No. 60/410,440, filed on Sep. 16, 2002.

(51) Int. Cl.
*B25B 7/12* (2006.01)

(52) U.S. Cl. ..... 81/367; 81/389; 81/302

(58) Field of Classification Search ..... 81/367, 81/389, 302

See application file for complete search history.

(56) References Cited

U.S. PATENT DOCUMENTS

| | | | | |
|---|---|---|---|---|
| 4,289,050 | A * | 9/1981 | Scafaro | 81/311 |
| 4,317,986 | A * | 3/1982 | Sullivan | 219/231 |
| 4,344,215 | A * | 8/1982 | Dearman | 29/281.5 |
| 4,716,899 | A * | 1/1988 | Huenefeld et al. | 606/117 |
| 6,578,452 | B2 * | 6/2003 | Duffy | 81/368 |

* cited by examiner

*Primary Examiner*—Lee D. Wilson
*Assistant Examiner*—Alvin J. Grant
(74) *Attorney, Agent, or Firm*—Charles C. Logan, II

(57) ABSTRACT

A clamping device utilizes the mechanism of conventional vise-grip locking pliers to clamp internally or to expand workpieces with adjustable force. The invention comprises a fixed arm, a movable arm with quick release mechanism, a pair of special design, crossed clamping arms with jaws. Also included with the invention is the rear adjustment screw attached to one end of the fixed arm for setting the clamping gap and the clamping force.

5 Claims, 3 Drawing Sheets

EXPANDER LOCKING PLIER

Note: This application is based on my provisional patent application filed on Sep. 16, 2002 with application No. 60/410,440.

REFERENCE CITED U.S. PATENT DOCUMENTS

| | | |
|---|---|---|
| 2,590,031 | March 1952 | Christian Petersen |
| 2,641,149 | June 1953 | Christian Petersen |
| 3,585,704 | June 1971 | J. A. Schroeder |
| 4,305,575 | December 1981 | Dale L. Bardes |
| 4,386,542 | June 1983 | Louis R. Verna |
| 4,477,937 | October 1984 | James Costello |
| 4,730,524 | March 1988 | Christian Petersen |
| 5,022,290 | June 1991 | Thomas F. Duffy |
| 5,305,669 | April 1994 | Gary A. Kimbro |

BACKGROUND OF THE INVENTION

1. Field of the Invention

The present invention relates to a class of locking pliers, or vise-grips in general, and more particularly to expander locking plier with easily adjustable clamping force. The invention is capable of clamping one or two workpieces against the internal surfaces of a tube, a fixture or another workpiece with adjustable clamping force. It is also capable to expand two portions of a workpiece or two workpieces apart by turning the rear adjustment screw mounted on the fixed arm. The screw and thread design of the jaws enable the adjustment of the invention to suit variable internal sizes of fixture or workpieces in concern.

2. Description of the Related Art

A conventional locking plier or vise-grip generally comprises a fixed arm with clamping jaw, a movable arm attached with clamping jaw and a self-locking and quick release mechanism built into the movable arm. To serve various applications, there are many different designs of the clamping jaws for locking pliers in the field, such as: cutter attachment jaws, U.S. Pat. No. 2,590,031; C-shape jaws used in the Gripping Tool, U.S. Pat. No. 2,641,149; cylindrical jaws used in tube and shaft clamping, U.S. Pat. Nos. 3,585,704 and 5,305,669; L-shape jaws used in Toe-nailing Clamping Tool, U.S. Pat. No. 4,305,575; very large gripping jaws, U.S. Pat. No. 4,386,542; chain clamping jaws, U.S. Pat. No. 4,477,937; long nose jaws, U.S. Pat. No. 4,730,524; and adjustable locking jaws, U.S. Pat. No. 5,022,290; etc. However, almost all of these designs are used to clamp externally on workpieces, or more accurately speaking, the clamping force is applied from outside towards the inside of the workpieces. Although not so common in the field, there are situations where clamping from the outside of a workpiece is not possible. Or there are applications that require the workpiece or workpieces being clamped inside a tube, or between two internal surfaces of a workpiece or fixture. Besides these static operations, there may be a situation that requires a means to expand two portions of a workpiece, or to push two workpieces apart with desired amount of force. It is the intention of the present invention to provide a handy tool to serve these purposes. Another intention is to enable the adjustment of the clamping force on the workpiece by turning the rear adjustment screw. Further intention of the present invention is to provide a convenient means to increase the expanding force on the workpieces by inserting a metal rod or any suitable screwdriver into the hole equipped on the rear adjustment screw to act as a handle to increase the turning torque. Yet another intention of the invention is to provide a simple means to adjust the workable size of the pliers. Such a simple means is the screw and thread design mounted to the jaws attached to the fixed arm and the movable arm.

SUMMARY OF THE INVENTION

The present invention comprises a fixed arm attached with a J-shape clamping arm and adjustable jaw at one end and with a rear adjustment screw at the other end, a movable arm with self-locking and quick release mechanism, and an adjustable moving jaw connecting the fixed arm and the movable arm by pivots. Similar to the design of a conventional locking plier, the crossed section of the fixed arm is U-shape at one end and cylindrical shape at the other end. At the U-shape end, the straight end of a L-shape metal plate is inserted and fixed with two rivets and the curved end of the L-shape metal plate is protruded outside the fixed arm. The J-shape clamping arm is made of two J-shape metal plates spaced apart by a rectangular metal block welded at the smaller end. The larger end of the J-shape clamping arm is riveted onto the protruded curved end of the L-shape metal plate. With such a construction, the J-shape clamping arm is hollow in the middle so that the adjustable moving jaw can be fed through it. The cylindrical end of the fixed arm is threaded inside to feed the rear adjustment screw which is an elongated thumb screw with a cylindrical hole drilled at right angle to the screw axis.

The movable arm is similar in design as a conventional locking plier. At one end the adjustable moving jaw is pivoted and at the other end the elongated release lever is attached. In between but closer to the end with the adjustable moving jaw, a toggle-like member is pivoted. The free end of this toggle-like member is inserted into the inside of the fixed arm and touching the inner end of the rear adjustment screw. The movable arm is connected to the fixed arm through the adjustable moving jaw with pivots and spring. The adjustable moving jaw is fed through the hollow portion in the middle of the J-shape clamping arm. The adjustable moving jaw is equipped with a long screw inserted into a threaded hole so that the length of the protrusion of the screw can be adjusted. Through the rectangular metal block a shorter screw is inserted to form the clamping jaw of the J-shape clamping arm. It is the crossed relationship between the adjustable moving jaw and the J-shape clamping arm that enables the expanding action when the movable arm is pressed against the fixed arm. To adjust for the clamping size and clamping force, the rear adjustment screw is turned clockwise or counterclockwise so that the inner end of the screw will change the position of the toggle-like member and hence the angular position of the adjustable moving jaw. If stronger clamping force is needed, a metal rod, a screw driver or any tool with a rod of the right size can be inserted into the cylindrical hole on the rear adjustment screw to turn it with the larger torque required.

The expanding action of the present invention makes internal clamping possible. Workpieces can be clamped between two opposite surfaces of a fixture or another workpiece, or clamped inside a tube. Another useful application of the present invention is to expand two workpieces or two portions of a workpiece apart with desired amount of force. The effective clamping size of the invention is adjustable by the screw and thread design of the adjustable moving jaw and the jaw attached to the J-shape clamping arm.

DETAILED DESCRIPTION OF THE INVENTION

With the help of the drawings and the detail description below, the features of the present invention will be apparent and fully understandable.

Figure 1:
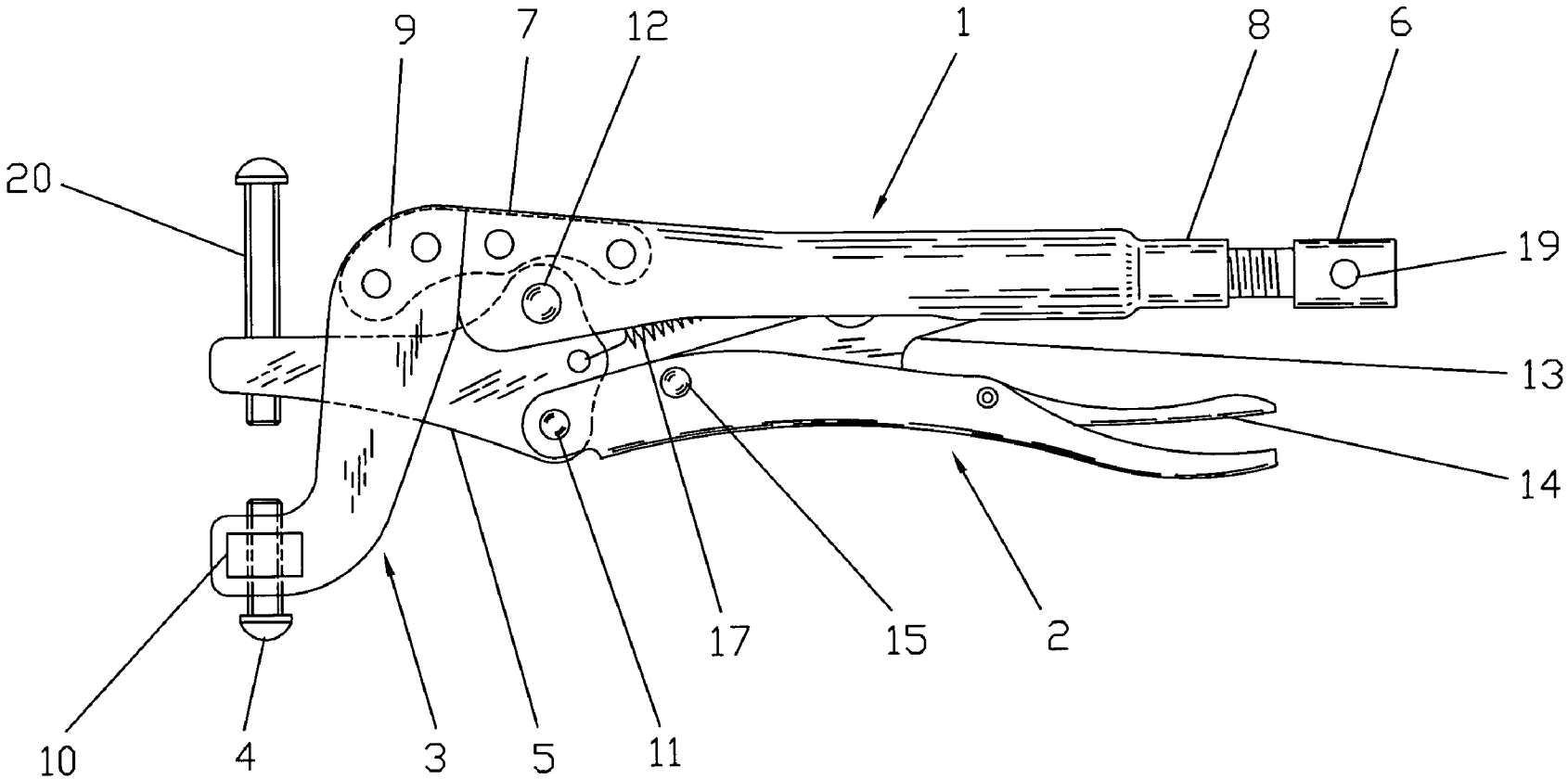
FIG. 1 is a side view of the invention.
Figure 2:
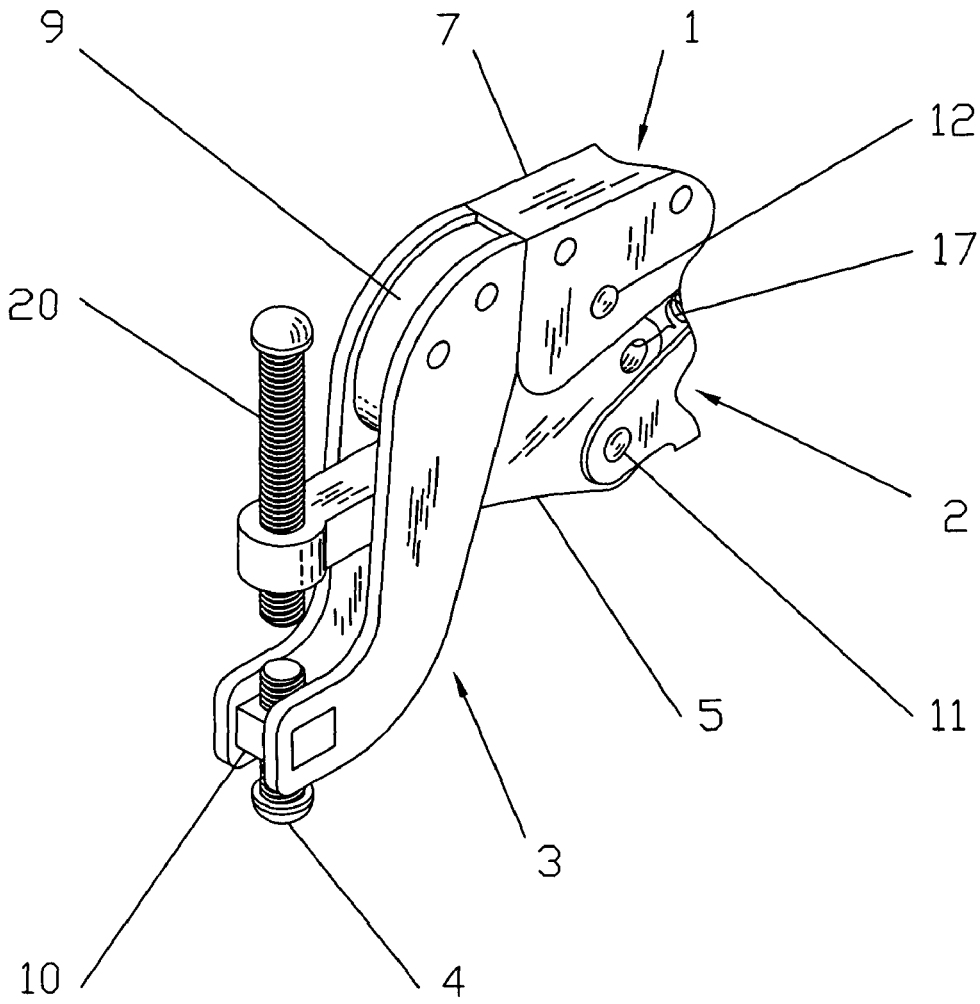
FIG. 2 is a perspective view of the front part of the invention showing the clamping jaws.

Referring to FIG. 1, the expander locking plier comprises a fixed arm 1, a movable arm 2 with self-locking and quick release mechanism, a J-shape clamping arm 3 with adjustable jaw 4, an adjustable moving jaw 5 and a rear adjustment screw 6. Resembling the fixed handle of a conventional locking plier without the clamping jaw, the crossed section of fixed arm 1 is U-shape at one end 7 and cylindrical shape at the other end 8 which is threaded inside. The straight portion of a L-shape metal plate 9 is fixed to end 7 with two rivets. The J-shape clamping arm 3 is made of two J-shape metal plates welded together with a rectangular metal block 10 at the smaller ends. The bigger end of the J-shape clamping arm 3 is riveted to the curved end of the L-shape metal plate 9. Hence the J-shape clamping arm 3 is hollow in the middle part so that the adjustable moving jaw 5 can be fed through it and free to move inside this part as shown in FIG. 2. Adjustable jaw 4 is a short screw feeding through the threaded hole of the rectangular metal block 10 so that the protrusion of the jaw can be adjusted as required. At the cylindrical end 8 of the fixed arm 1, the rear adjustment screw 6 is screwed into the internal thread of end 8. This screw 6 is used to adjust the clamping size between the clamping jaws and to adjust the clamping force also. At the outside end of screw 6, a cylindrical hole 19 is drilled at right angle to the axis of the screw for inserting a metal rod or any tool with a metal rod of the right size such as a screwdriver to increase the clamping force by applying a larger torque.

With reference to FIG. 1 and FIG. 2, the adjustable moving jaw 5 is pivoted to the U-shape end 7 of fixed arm 1 with pivot 12. A tensional coil spring 17 is hooked to a hole on the adjustable moving jaw 5. The other end of spring 17 is hooked to an ear inside the middle of the fixed arm 1. Spring 17 is used to provide the pulling force on the adjustable moving jaw 5 for quick releasing and opening. At the outside end of the adjustable moving jaw 5, a threaded hole is provided to insert the screw-like jaw 20 which is used to adjust the effective clamping gap between the clamping jaws 4 and 20. The adjustable moving jaw 5 is fed through the hollow middle part of the J-shape clamping arm 3 so that a crossed relationship between the J-shape clamping arm 3 and the adjustable moving jaw 5 is established. This crossed relationship provides the expanding action of the two jaws 4 and 20 when the movable arm 2 is pressed towards the fixed arm 1. With such a design, the present invention is capable of expanding two workpieces, or two portions of a workpiece apart with an adjustable force. It is also capable of clamping two workpieces internally inside a tube, or against two internal surfaces of a fixture or another workpiece. The effective clamping size of the invention is adjustable by the rear adjustment screw 6 and the screw and thread design of clamping jaws 4 and 20.

Figure 3:
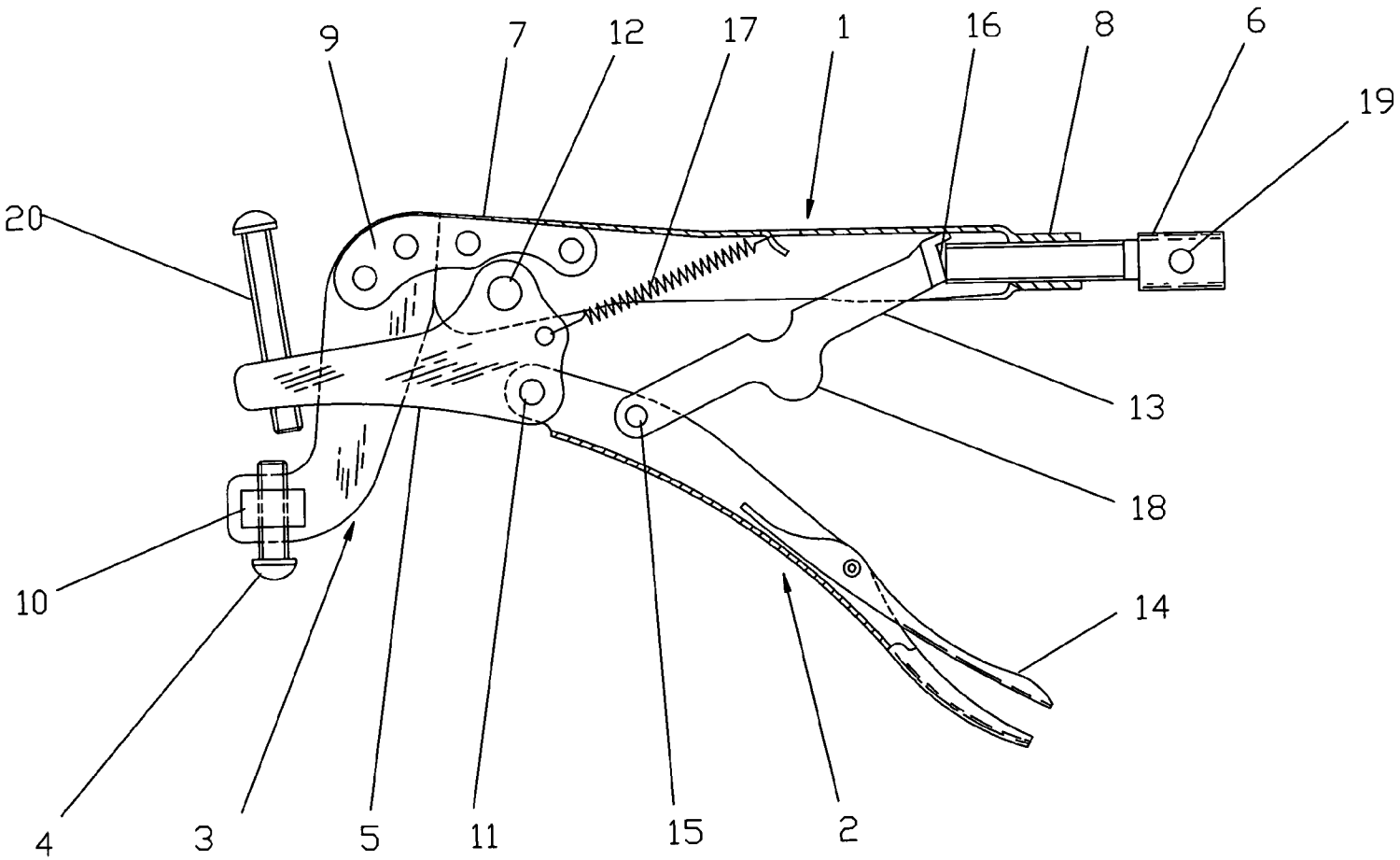
FIG. 3 is an exploded side view of the invention with the clamping arms at the open position.

Referring to FIG. 1 and FIG. 3, movable arm 2 is similar in design and function as the movable handle of a conventional locking plier. It is connected to the fixed arm 1 through the adjustable moving jaw 5 with pivots 11 and 12. A toggle-like member 13 is pivoted to the movable arm 2 next to pivot 11 with pivot 15, the opposite end 16 is inserted to the cylindrical end 8 of the fixed arm 1 touching the inside end of the rear adjustment screw 6. Toggle-like member 13 is used to provide the pushing and locking action and hence the clamping force to the adjustable moving jaw 5 during clamping operation. An elongated release lever 14 is pivoted to the free end of the movable arm 2 with the inner tip touching the notch 18 of the toggle-like member 13. While the present invention is in clamping position, that is, the pivot 11, pivot 15 and the end 16 of toggle-like member 13 are in a straight line, pressing the elongated release lever 14 will push the notch of the toggle-like member 13 to break such an in-line relationship so that the clamping force exerted on the adjustable moving jaw 5 is released instantly, and the adjustable moving jaw 5 is pulled away immediately from the workpiece by the pulling action of the spring 17. Hence the workpiece (workpieces) is (are) released instantly.

What I claim as my invention is:

1. An expander locking plier having a fixed arm and a moveable arm linked together by a helical spring and a quick release mechanism similar to the design of a conventional locking plier comprising:

a J-shape clamping arm with an adjustable fixed jaw attached to a first end of said fixed arm; said J-shape clamping arm is attached with its straight end at a right angle to said first end of said fixed arm through a L-shape metal plate with a plurality of rivets;

an adjustable moving jaw pivoted to one end of said movable arm, forming a crossed relationship with said J-shape clamping arm; and a rear adjustment screw with a cylindrical hole inserted into a second end of said fixed arm.

2. An expander locking plier having a fixed arm and a moveable arm linked together by a helical spring and a quick release mechanism similar to the design of a conventional locking plier comprising:

a J-shape clamping arm with an adjustable fixed jaw attached to a first end of said fixed arm; said J-shape clamping arm is made of two J-shape metal plates spaced apart and fixed at its straight end by said L-shape metal plate and spaced apart and fixed at its curved end by a rectangular metal block forming a hollow section at middle portion of said J-shape clamping arm;

an adjustable moving jaw pivoted to one end of said movable arm, forming a crossed relationship with said J-shape clamping arm; and a rear adjustment screw with a cylindrical hole inserted into a second end of said fixed arm.

3. The expander locking plier according to claim 2, wherein said rectangular metal block is equipped with a vertical threaded hole to accept said adjustable fixed jaw.

4. An expander locking plier having a fixed arm and a moveable arm linked together by a helical spring and a quick release mechanism similar to the design of a conventional locking plier comprising:

a J-shape clamping arm with an adjustable fixed jaw attached to a first end of said fixed arm;

an adjustable moving jaw pivoted to one end of said movable arm, forming a crossed relationship with said J-shape clamping arm; said adjustable moving jaw consists of a solid metal shank with a larger end connecting said fixed arm and said moveable arm by pivots and with a smaller end feeding through said hollow section at said middle portion of said J-shape clamping arm to form said crossed relationship; and a rear adjustment screw with a cylindrical hole inserted into a second end of said fixed arm.

5. An expander locking plier having a fixed arm and a moveable arm linked together by a helical spring and a quick release mechanism similar to the design of a conventional locking plier comprising:

a J-shape clamping arm with an adjustable fixed jaw attached to a first end of said fixed arm;

an adjustable moving jaw pivoted to one end of said movable arm, forming a crossed relationship with said J-shape clamping arm; and a rear adjustment screw with a cylindrical hole inserted into a second end of said fixed arm;

said rear adjustment screw having a cylindrical head consisting of said cylindrical hole, said cylindrical hole being made at right angle to the axis of said cylindrical head to accept a metal rod or a screw driver when greater clamping force is required.

* * * * *